US006357807B1

(12) United States Patent
Fan

(10) Patent No.: US 6,357,807 B1
(45) Date of Patent: Mar. 19, 2002

(54) DOOR LOCK

(76) Inventor: Fang-Yi Fan, No. 186, Min-Kuo Rd., Chia-Yi City (TW)

( * ) Notice: Subject to any disclaimer, the term of this patent is extended or adjusted under 35 U.S.C. 154(b) by 0 days.

(21) Appl. No.: 09/490,579

(22) Filed: Jan. 25, 2000

(51) Int. Cl.[7] ..... E05C 3/16
(52) U.S. Cl. ..... 292/226; 292/336.3
(58) Field of Search ..... 292/336.3, 226, 292/200

(56) References Cited

U.S. PATENT DOCUMENTS 5,496,082 A * 3/1996 Zuckerman ..... 292/336.3
5,556,144 A * 9/1996 Lin ..... 292/336.3
5,617,749 A * 4/1997 Park ..... 70/224
5,727,406 A * 3/1998 Banducci ..... 70/224
5,732,578 A * 3/1998 Kang ..... 70/224
5,941,108 A * 8/1999 Shen ..... 292/336.3 X

FOREIGN PATENT DOCUMENTS

GB 272478 * 5/1994 ..... 292/336.3

* cited by examiner

*Primary Examiner*—Teri Pham Luu
(74) *Attorney, Agent, or Firm*—Ladas & Parry

(57) ABSTRACT

A door lock includes a handle, a lever seat having a lever, a cam for camming the lever, a handle orienting unit, a transmission shaft connected to the handle and the cam, and a latch operable by the lever. The lever seat has an annular flange and two opposite lugs. The cam has a tubular stud extending into the annular flange. The tubular stud has a bifurcated end formed with two slits. The handle orienting unit has a torsion spring and a cap having a base wall and a peripheral side wall which has two notched edges. The torsion spring has two end sections abutting respectively against one of the notched edges and one of the lugs. The base wall has an inner edge having two tongues that engage respectively the slits of the bifurcated end.

1 Claim, 9 Drawing Sheets

DOOR LOCK

BACKGROUND OF THE INVENTION

1. Field of the Invention

This invention relates to a door lock, more particularly to a door lock adapted to be mounted on a door of a building.

2. Description of the Related Art

FIGS. 1 to 4 illustrate a conventional door lock 1 adapted to be mounted on a door 2 of a building. The door lock 1 includes an escutcheon 11 mounted on one side of the door 2, a handle 12 mounted rotatably on the escutcheon 11, a handle orienting unit 13 mounted on the escutcheon 11 between the escutcheon 11 and the door 2, a transmission shaft 10 connected to the handle 12, a lever seat 14 mounted on the other side of the door 2, a lever 16 mounted rotatably on the lever seat 14, a cam 15 mounted rotatably on the lever seat 14 for camming the lever 16, and a latch 17 mounted rotatably on the lever seat 14 and being operable by the lever 16.

The escutcheon 11 has a bottom plate 111 confronting the door 2, and two opposite side plates 116 projecting from the bottom plate 111 toward the door 2. An opening 112 is formed in the bottom plate 111. A first annular flange 113 projects from the bottom plate 111 around the opening 112 toward the door 2. Two opposite lugs 114 extend laterally and respectively from the opposite side plates 116. A pair of opposite nuts 115 project from the bottom plate 111, and are inserted into apertures 25 in the door 2.

The handle 12 has a gripping section 121, and a tubular section 122 extending from one end of the gripping section 121 toward the escutcheon 11. The tubular section 122 has a thickness reduced end 123 that extends through the opening 112 in the base plate 111 and the first annular flange 113. A C-shaped locking spring 124 is sleeved on an annular groove formed in the thickness reduced end 123 of the tubular section 122 for preventing the handle 12 from moving in an axial direction.

The transmission shaft 10 has a square-shaped cross-section, and opposite front and rear ends 101, 102. The front end 101 of the transmission shaft 10 extends through the first annular flange 113 into the tubular section 122 of the handle 12. The rear end 102 of the transmission shaft 10 is adapted to extend through a through-hole 24 in the door 2 to the lever seat 14.

The handle orienting unit 13 has a torsion spring 131 sleeved around the first annular flange 113 and the thickness reduced end 123 of the tubular section 122, and a cap 132 having a base wall 135 confronting the first annular flange 113, and a peripheral side wall 136 that projects from the base wall 135 toward the bottom plate 111 and that surrounds the torsion spring 131 and the first annular flange 113. The peripheral side wall 136 has two diametrically opposed notches 138 which have notched edges 139 formed thereon. The torsion spring 131 has two opposite radially extending end sections 134 extending outwardly of the peripheral side wall 136 through the notched edges 139 to the lugs 114, respectively. One of the end sections 134 of the torsion spring 131 abuts against one of the notched edges 139, and the other one of the end sections 134 of the torsion spring 131 abuts against one of the lugs 114. The base wall 135 has an inner edge, 137 defining a central opening that is square in shape and that aligned with the opening 112 in the bottom plate 111. A hollow sleeve 133, which has a square-shaped cross-section, is inserted into the central opening in the base wall 135, and extends therefrom to the door 2. The sleeve 133 engages the inner edge 137 of the base wall 135, and is sleeved around and engages the transmission shaft 10 so that the torsion spring 131 and the cap 132 are rotatable about the transmission shaft 10 via the sleeve 133 when the transmission shaft 10 rotates. The arrangement of the handle orienting unit 13 permits the handle 12 and the latch 17, which will be described in more detail below, to be returned from an unlatching position to a latching position.

The lever seat 14 has a base plate 141 and two side plates 143 projecting outwardly from two opposite sides of the base plate 141 toward the door 2. Two opposite nuts 144 project outwardly from the base plate 141 toward the door 2 for receiving two bolts 18 that extend through the door 2 into the nuts 115 of the bottom plate 111 of the escutcheon 11, thereby fastening the lever seat 14 and the escutcheon 11 on the door 2. An opening 148 is formed in the base plate 141 between the opposite side plates 143. A second annular flange 145 projects from the base plate 141 toward the door 2 around the opening 148 in the base plate 141. Two opposite rear plates 142 project outwardly from the base plate 141 at one side of the base plate 141 opposite to the side plates 143.

The cam 15 has a hollow tubular stud 153 extending through the opening 148 in the base plate 141 into the second annular flange 145, and a camming portion 152 extending from one end of the stud 153 to the opposite rear plates 142 for camming the lever 16. The rear end 102 of the transmission shaft 10 extends into the tubular stud 153 of the cam 15. The stud 153 has an end 151 that extends through the flange 145 adjacent to the door 2 and that is formed with an annular groove for receiving a C-shaped locking spring 154 which prevents the cam 15 from moving in an axial direction.

The lever 16 is disposed between the rear plates 142, and has a pressing portion 163 and a pivoting portion 164 projecting outwardly from the pressing portion 163 and mounted pivotally on the rear plates 142 via a first pivot pin 161 extending through the pivoting portion 164 and the rear plates 142. The pivoting portion of the lever 16 has an end portion 162 that engages the camming portion 152 at one side and that engages the latch 17 at the other side so that the latch 17 is operable by the handle 12 via the transmission shaft 10, the cam 15, and the lever 16.

The latch 17 is disposed between the rear plates 142, and has a free end 173 and a pivoting end 172 opposite to the free end 173. The pivoting end 172 is mounted pivotally on the rear plates 142 via a second pivoting pin 171 extending through the pivoting end 172 of the latch 17 and the rear plates 142. The pivoting end 172 of the latch 17 engages the end portion 162 of the pivoting portion 164 of the lever 16 so that the free end 173 of the latch 17 is adapted to engage and disengage a door frame 23 by the lever 16. A coil spring 174 is disposed between and abuts against the lever 16 and the latch 17 for providing a force to move the free end 173 of the latch 17 to engage the door frame 23.

The aforementioned door lock 1 has disadvantages in that the handle orienting unit 13 is arranged at the escutcheon 11, while the cam 15, the lever 16, and the latch 17 are arranged at the lever seat 14 (see FIG. 4). As a result, the assembly of these parts is laborious. Moreover, after installation of the handle orienting unit 13 on the escutcheon 11, the sleeve 133 must be bulged so as to prevent the handle orienting unit 13 from moving in an axial direction.

SUMMARY OF THE INVENTION

Therefore, it is an object of the present invention to provide a door lock that is capable of overcoming the aforementioned problem.

Accordingly, a door lock of this invention comprises: a handle having a transmission shaft and adapted to be mounted rotatably on one side of a door; a lever seat having a lever mounted rotatably thereon, disposed opposite to the handle, and adapted to be mounted securely on the other side of the door, the lever seat having a vertically disposed base plate, two opposite side plates extending laterally and respectively from two opposite sides of the base plate toward the handle, an opening formed in the base plate between the side plates, an annular flange projecting from the base plate around the opening toward the handle, and two opposite lugs extending transversely of and respectively from the opposite side plates toward the annular flange; a cam mounted rotatably on the lever seat for camming the lever, the cam having a tubular stud extending therefrom through the opening in the base plate into the annular flange and sleeved on an end section of the transmission shaft, the tubular stud having a bifurcated end which extends through the annular flange toward the handle and which is formed with two diametrically opposed slits; a handle orienting unit mounted rotatably on the base plate and having a torsion spring sleeved around the annular flange, and a cap having a base wall confronting the annular flange and a peripheral side wall that projects from the base wall toward the base plate and that surrounds the torsion spring and the annular flange, the peripheral side wall having two diametrically opposed notched edges formed thereon, the torsion spring having two opposite radially extending end sections extending outwardly of the peripheral side wall through the notched edges to the lugs, respectively, one of the end sections of the torsion spring abutting against one of the notched edges and the other one of the end sections of the torsion spring abutting against one of the lugs, the base wall having an inner edge which defines a central slot aligned with the opening in the base plate, and two diametrically opposed tongues projecting into the inner edge, the bifurcated end of the tubular stud extending through the slot with the slits engaging respectively the tongues, the tubular stud further having a locking spring sleeved tightly around the bifurcated end at one side of the base wall opposite to the torsion spring; and a latch being operable by the lever, adapted to engage a latch hole in a door frame at one end, and mounted rotatably on the lever seat at the other end, the latch being rotatable between an unlatching position and a latching position.

BRIEF DESCRIPTION OF THE DRAWINGS

In drawings which illustrate an embodiment of the invention.

DETAILED DESCRIPTION OF THE PREFERRED EMBODIMENT

Figure 1:
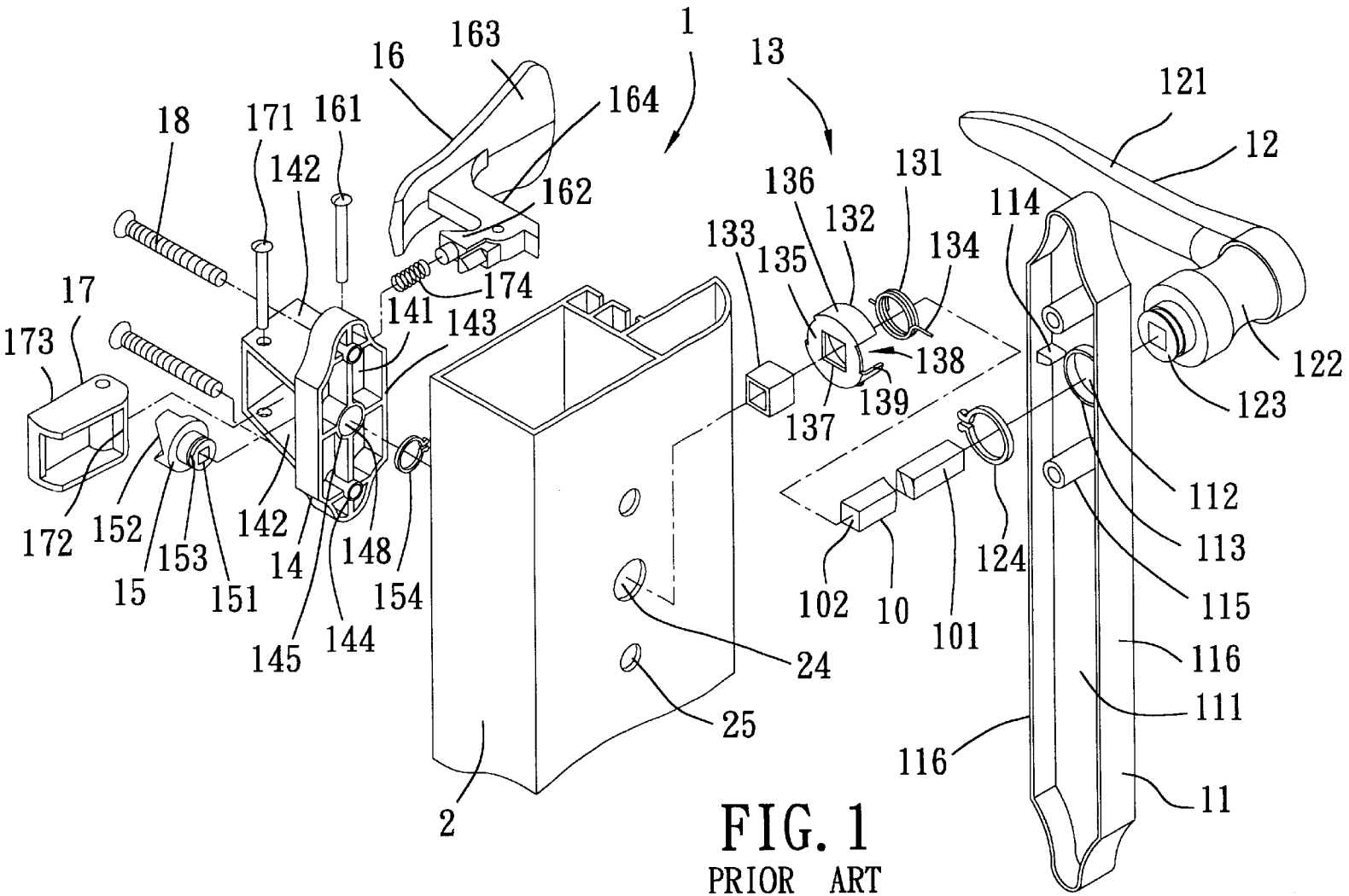
FIG. 1 PRIOR ART
FIG. 1 is an exploded view of a conventional door lock.
Figure 2:
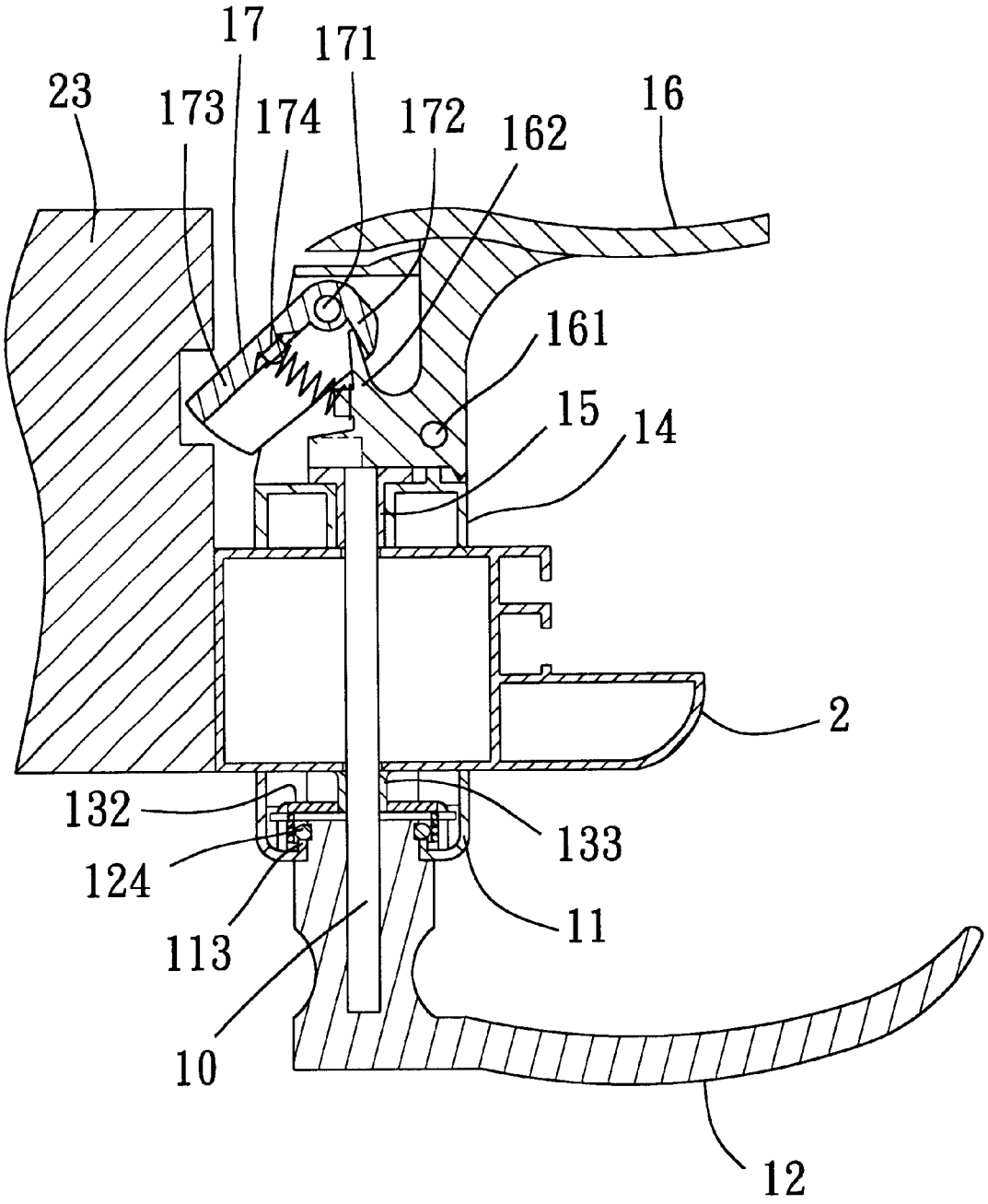
FIG. 2 PRIOR ART
FIG. 2 is a cross-sectional side view of the door lock of FIG. 1.
Figure 3:
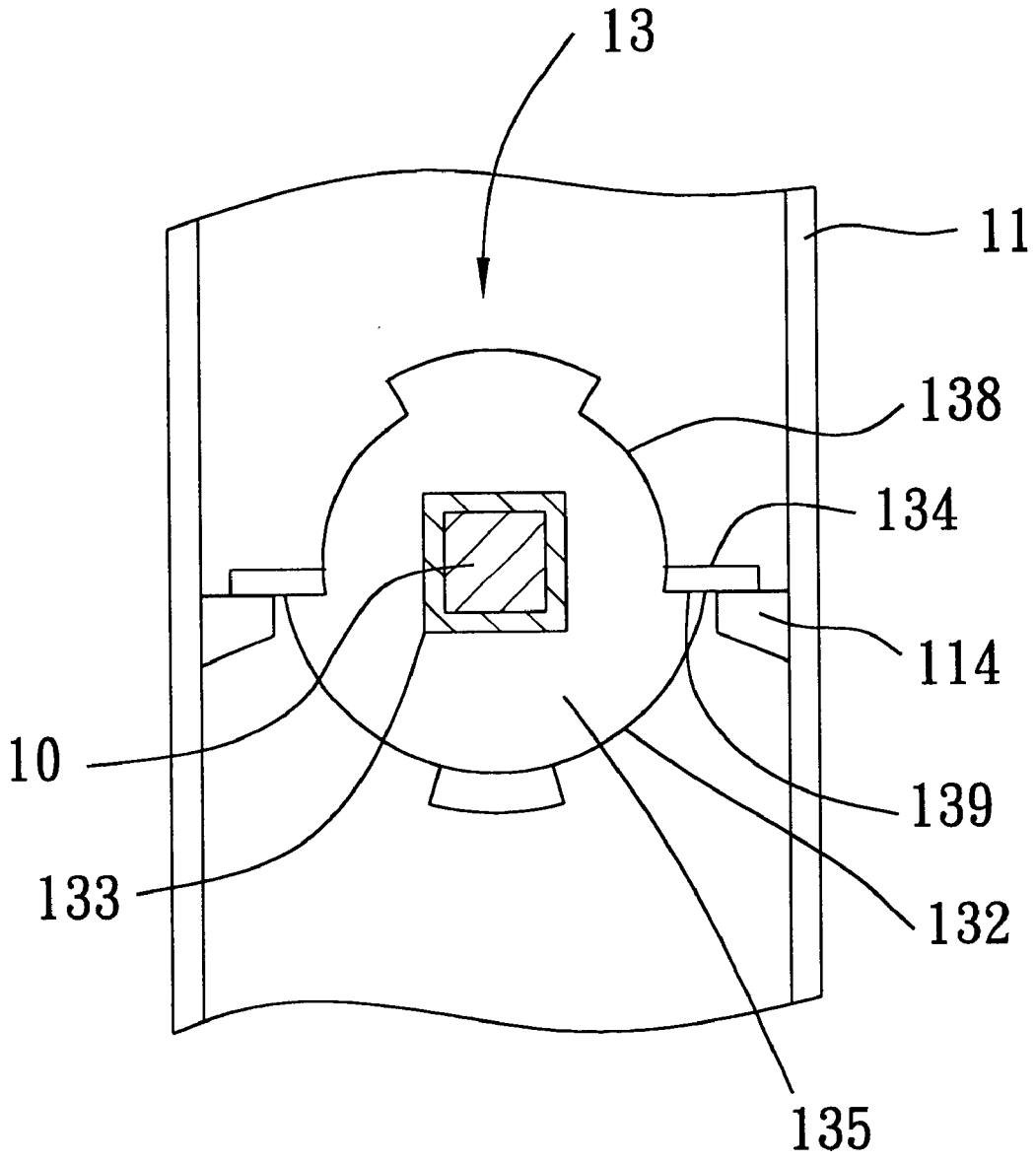
FIG. 3 PRIOR ART
FIG. 3 is a fragmentary cross-sectional side view of the door lock of FIG. 1.
Figure 4:
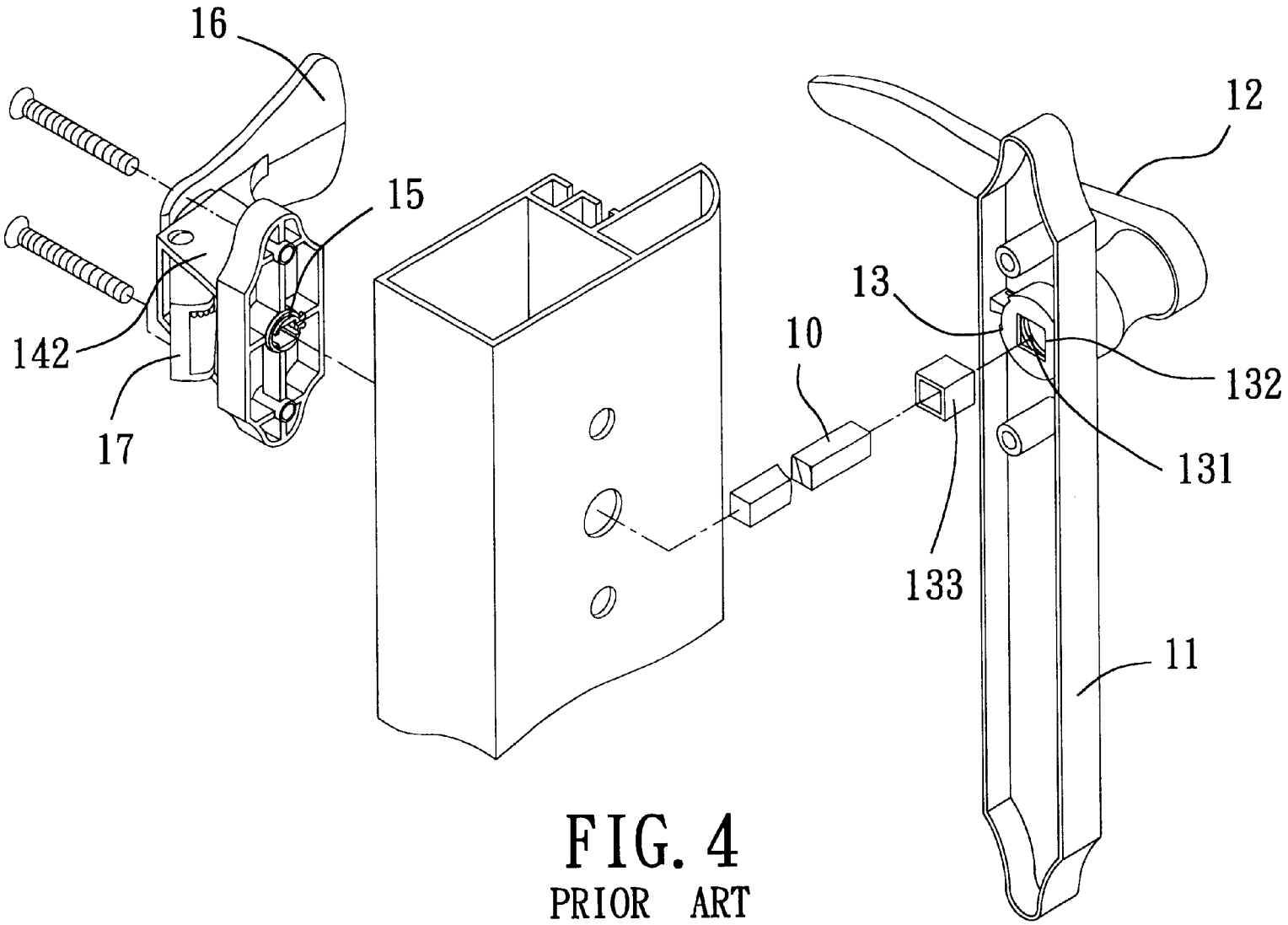
FIG. 4 PRIOR ART
FIG. 4 is another exploded view of the door lock of FIG. 1.
Figure 5:
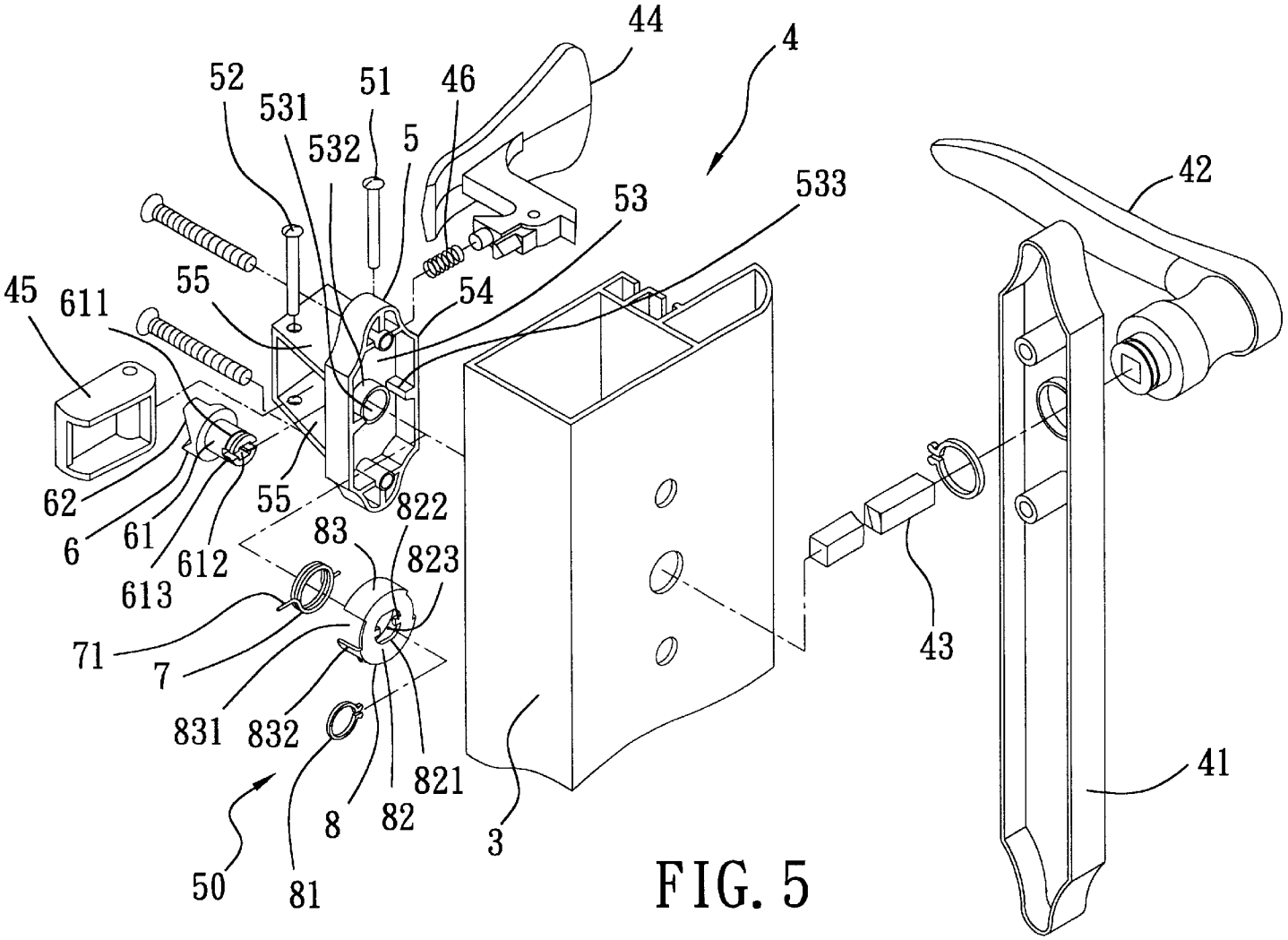
FIG. 5 is an exploded view of a door lock embodying this invention.
Figure 6:
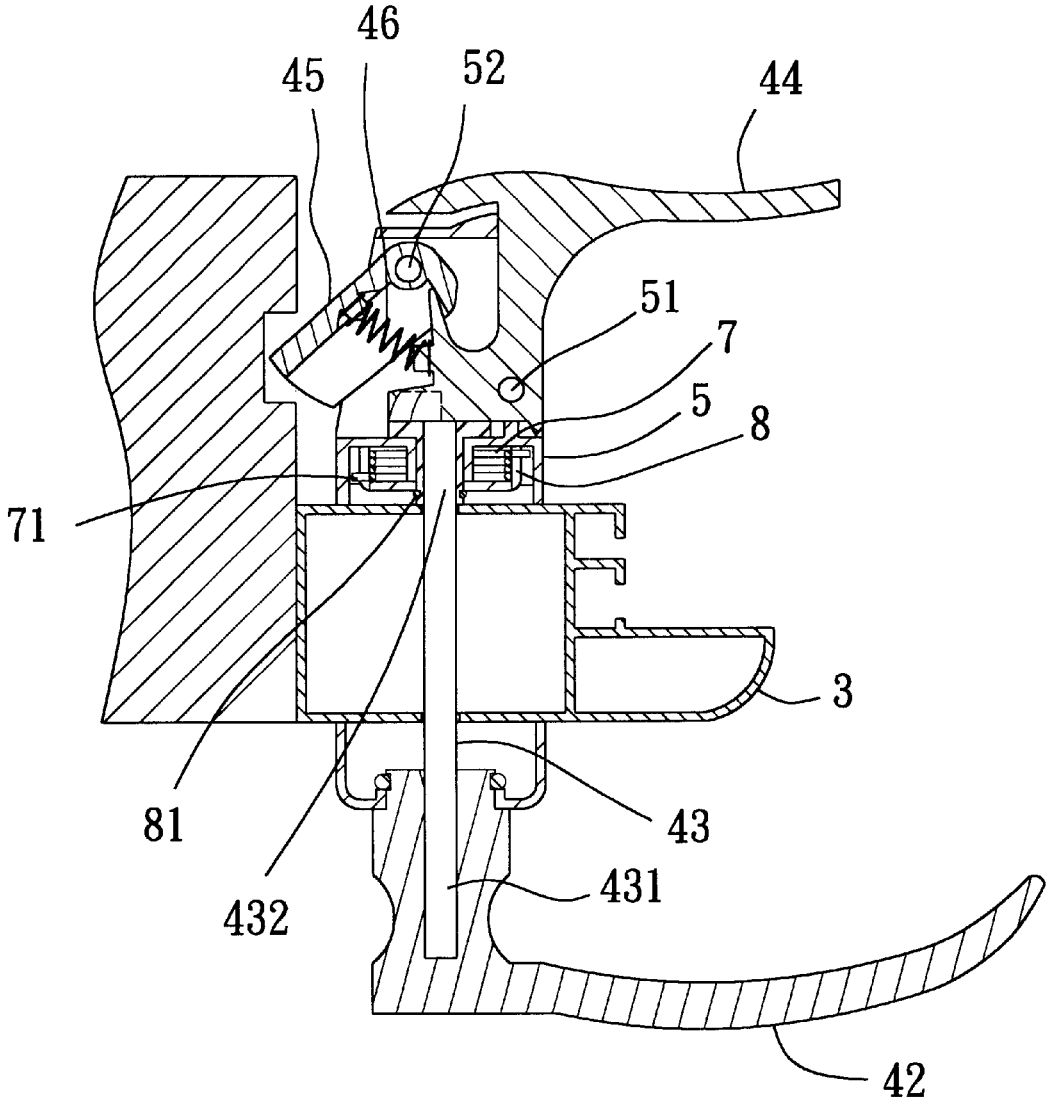
FIG. 6 is a cross-sectional side view of the door lock of FIG. 5 in a latching position.
Figure 7:
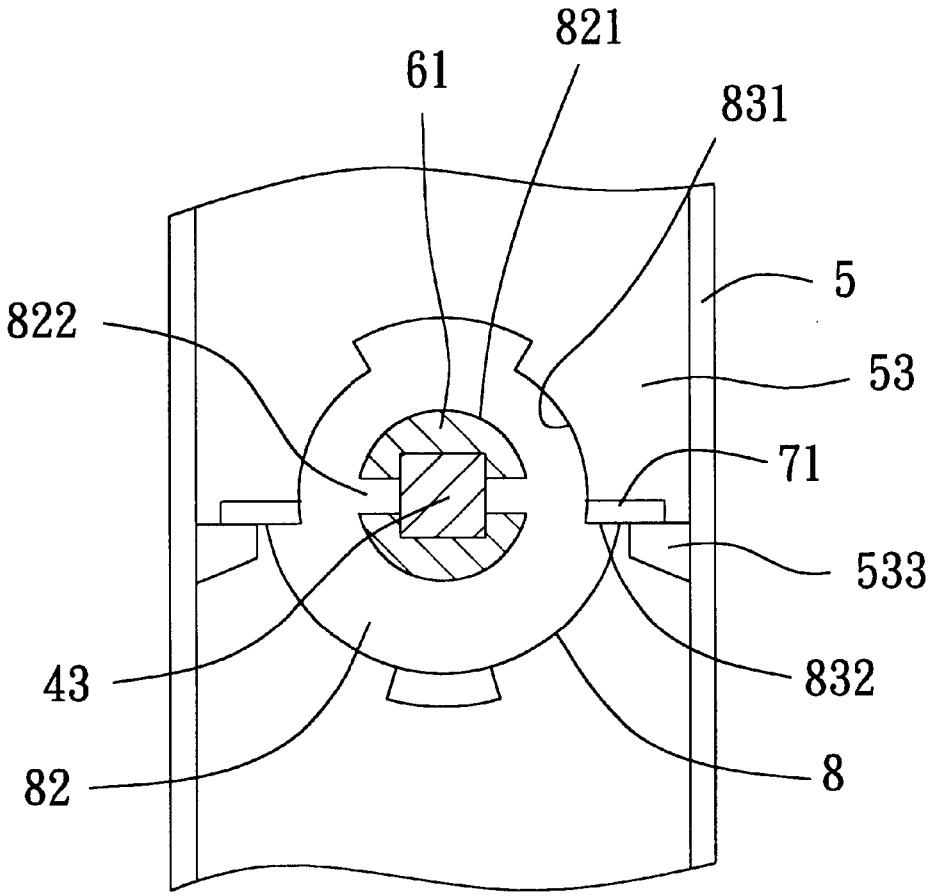
FIG. 7 is a fragmentary cross-sectional side view of the door lock of FIG. 5.

FIGS. 5 to 7 illustrate a door lock 4 embodying this invention. The door lock 4 includes an escutcheon 41 adapted to be mounted securely on one side of a door 3, a lever seat 5 adapted to be mounted securely on the other side of the door 31 a handle 42 mounted rotatably on the escutcheon 41, a transmission shaft 43 adapted to extend through the door 3 and having two opposite ends extending to the handle 42 and the lever seat 5, a handle orienting unit 50 mounted rotatably on the lever seat 5, a lever 44 mounted pivotally on the lever seat 5, and a latch 45 mounted pivotally on the lever seat 5.

The lever seat 5 has a vertically disposed base plate 53, two opposite side plates 54 extending laterally and respectively from two opposite sides of the base plate 53 toward the handle 42, an opening 531 formed in the base plate 53 between the side plates 54, an annular flange 532 projecting from the base plate 53 around the opening 531 toward the handle 42, and two opposite lugs 533 extending transversely of and respectively from the side plates 54 toward the annular flange 532. Two spaced apart and opposite rear plates 55 are disposed at one side of the base plate 53 opposite to the side plates 54, and project from the base plate 53 in a direction away from the handle 42.

The cam 6 has a camming end portion 62 disposed between the rear plates 55 for camming the lever 44, and a hollow tubular stud 61 that extends from the camming end portion 62 through the opening 531 into the annular flange 532 and that is sleeved on one of the two opposite ends of the transmission shaft 43. The other one of the two opposite ends of the transmission shaft 43 extends into and is connected to the handle 42. The tubular stud 61 has a bifurcated end 612 which extends through the annular flange 532 toward the handle 42 and which is formed with two diametrically opposed slits 613. An annular groove 611 is formed in the bifurcated end 612.

The handle orienting unit 50 includes a torsion spring 7 sleeved around the annular flange 532, and a cap 8 that has a base wall 82 confronting the annular flange 532 and a peripheral side wall 83 which projects from the base wall 82 toward the base plate 53 and which surrounds the torsion spring 7 and the annular flange 532. The peripheral side wall 83 has two diametrically opposed notches 831 formed thereon. The torsion spring 7 has two opposite radially extending end sections 71 extending outwardly of the peripheral side wall 83 through the opposed notches 831 to the lugs 533, respectively. One of the end sections 71 of the torsion spring 7 abuts against a notched edge 832 of one of the notches 831. The other one of the end sections 71 of the torsion spring 7 abuts against one of the lugs 533. The base wall 82 has an inner edge 821 which defines a central slot 823 aligned with the opening 531 in the base plate 53, and two diametrically opposed tongues 822 projecting from the inner edge 821 into the central slot 823. The bifurcated end 612 of the tubular stud 61 extends through the central slot 823 with the slits 613 engaging tightly the tongues 822 of the base wall 82. A C-shaped locking spring 81 is sleeved tightly in the annular groove 611 of the bifurcated end 612 of the tubular stud 61 at one side of the base wall 82 opposite to the torsion spring 81 for preventing the handle orienting unit 50 from moving in an axial direction.

The lever 44 is mounted pivotally on the rear plates 55 via a first pivot pin 51, and engages the camming end portion 62 of the cam 6 so as to be rotatable about the first pivot pin 51 by the cam 6.

Figure 8:
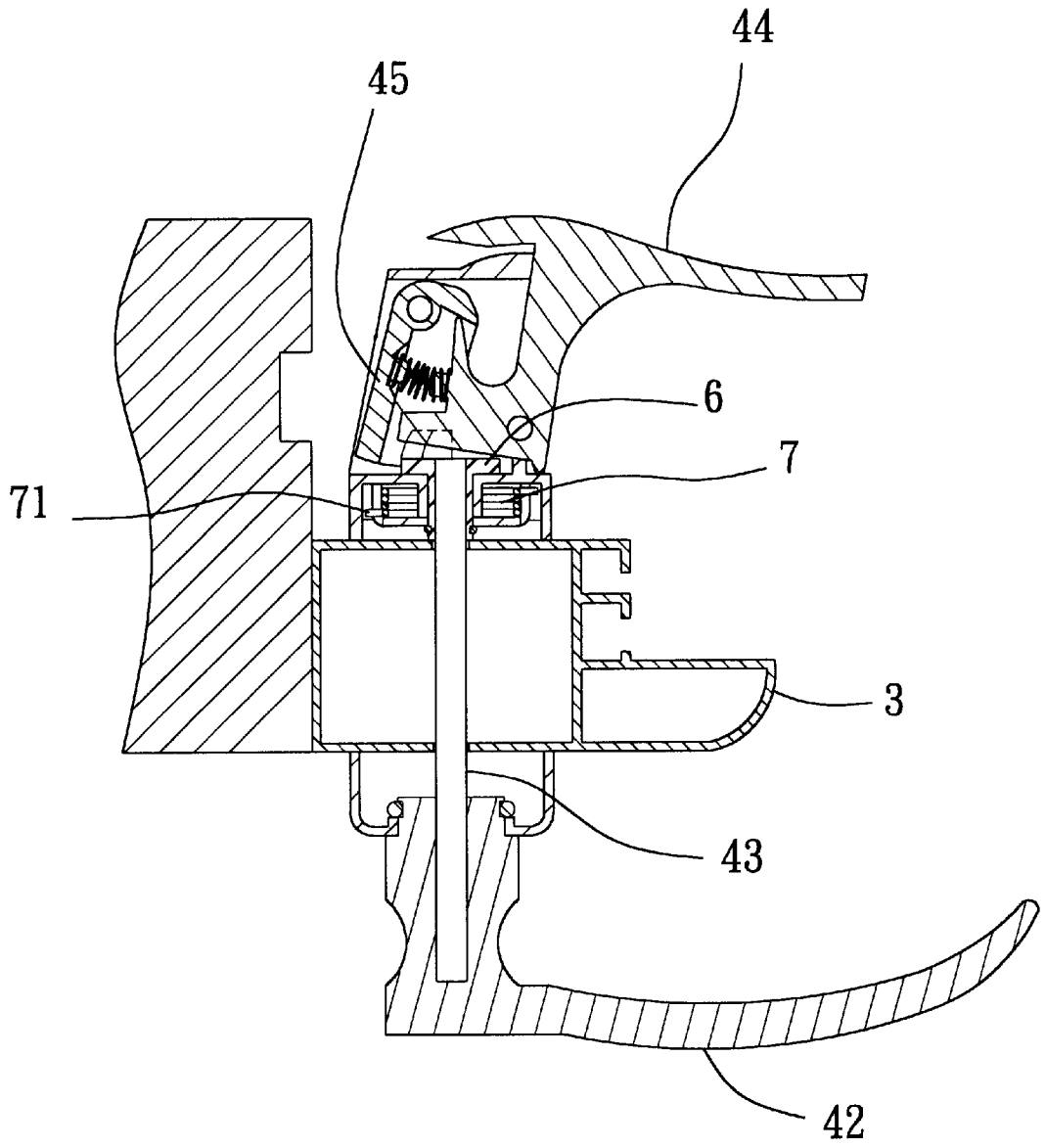
FIG. 8 is a cross-sectional side view of the door lock of FIG. 5 in an unlatching position.

The latch 45 is mounted pivotally on the rear plates 55 via a second pivot pin 52, and engages the lever 44 so as to be rotatable about the second pivot pin 52 by the lever 44 in order to move between an unlatching position (see FIG. 8) and a latching position (see FIG. 6). A coil spring 46 is disposed between and abuts against the lever 44 and the latch 45 for providing an urging force to move the latch 45 from the unlatching position to the latching position.

Figure 9:
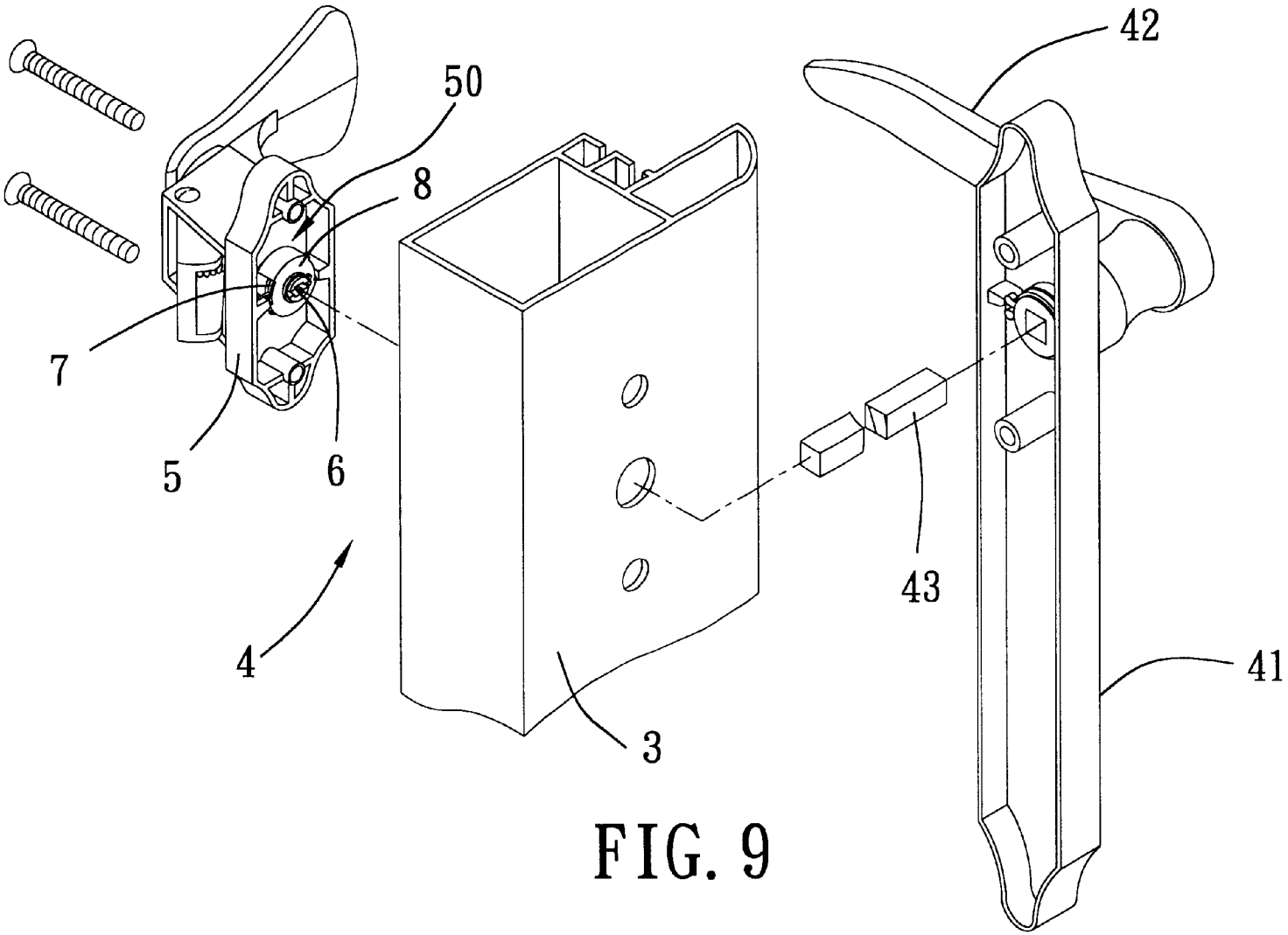
FIG. 9 is another exploded view of the door lock of FIG. 5.

Referring now to FIG. 9, since the handle orienting unit 50 is assembled along with the cam 6, the lever 44, and the latch 45 in the lever seat 5, such assembly is less laborious than that of the conventional door lock described above. Moreover, the door lock 4 of this invention dispenses with the sleeve and the bulging required in the conventional door lock.

With the invention thus explained, it is apparent that various modifications and variations can be made without departing from the spirit of the present invention. It is therefore intended that the invention be limited only as recited in the appended claims.

I claim:

1. A door lock, comprising:

a handle having a transmission shaft and adapted to be mounted rotatably on one side of a door;

a lever seat having a lever mounted rotatably thereon, disposed opposite to said handle, and adapted to be mounted securely on the other side of the door, said lever seat having a vertically disposed base plate, two opposite side plates extending laterally and respectively from two opposite sides of said base plate toward said handle, an opening formed in said base plate between said side plates, an annular flange projecting from said base plate around said opening toward said handle, and two opposite lugs extending transversely of and respectively from said opposite side plates toward said annular flange;

a cam mounted rotatably on said lever seat for camming said lever, said cam having a tubular stud extending therefrom through said opening in said base plate into said annular flange and sleeved on an end section of said transmission shaft, said tubular stud having a bifurcated end which extends through said annular flange toward said handle and which is formed with two diametrically opposed slits;

a handle orienting unit mounted rotatably on said base plate and having a torsion spring sleeved around said annular flange, and a cap having a base wall confronting said annular flange and a peripheral side wall that projects from said base wall toward said base plate and that surrounds said torsion spring and said annular flange, said peripheral side wall having two diametrically opposed notched edges formed thereon, said torsion spring having two opposite radially extending end sections extending outwardly of said peripheral side wall through said notched edges to said lugs, respectively, one of said end sections of said torsion spring abutting against one of said notched edges and the other one of said end sections of said torsion spring abutting against one of said lugs, said base wall having an inner edge which defines a central slot aligned with said opening in said base plate, and two diametrically opposed tongues projecting into said inner edge, said bifurcated end of said tubular stud extending through said slot with said slits engaging respectively said tongues, said tubular stud further having a locking spring sleeved tightly around said bifurcated end at one side of said base wall opposite to said torsion spring; and a latch being operable by said lever, adapted to engage a latch hole in a door frame at one end, and mounted rotatably on said lever seat at the other end, said latch being rotatable between an unlatching position and a latching position.

* * * * *